United States Patent [19]

Mazelle

[11] Patent Number: 4,934,964

[45] Date of Patent: Jun. 19, 1990

[54] ELECTRIC CONTACT TERMINAL

[75] Inventor: Christian Mazelle, Saclay, France

[73] Assignee: Souriau et Cie, Boulogne Billancourt, France

[21] Appl. No.: 225,350

[22] Filed: Jul. 28, 1988

[30] Foreign Application Priority Data

Aug. 3, 1987 [FR] France ..... 87 11001

[51] Int. Cl.[5] ..... H01R 13/00

[52] U.S. Cl. ..... 439/843

[58] Field of Search ..... 439/843

[56] References Cited

U.S. PATENT DOCUMENTS

| | | | |
|---|---|---|---|
| 3,564,487 | 2/1971 | Upstone et al. | 439/843 |
| 4,262,987 | 4/1981 | Gallisser et al. | 439/843 |
| 4,373,773 | 2/1983 | Piscitelli et al. | 439/843 |
| 4,431,256 | 2/1984 | Piscitelli et al. | 439/843 |
| 4,621,887 | 11/1986 | Piscitelli et al. | 439/843 |

FOREIGN PATENT DOCUMENTS

| | | |
|---|---|---|
| 0133377 | 2/1985 | European Pat. Off. . |
| 2596588 | 10/1987 | France . |

*Primary Examiner*—Joseph H. McGlynn

*Attorney, Agent, or Firm*—Larson and Taylor

[57] ABSTRACT

An electrical contact terminal for use in a connector comprises a body having a front tubular contact fractionated into circumferentially distributed contact fingers by longitudinal slots and a rear shank. The shank is shaped to receive an electric wire and is continuous, thereby improving connection with the wire. The connecting zone between the tubular contact and shank is radially expanded and the expansion is clamped in the flared end part of an external protection tube surrounding the front tubular contact.

9 Claims, 1 Drawing Sheet

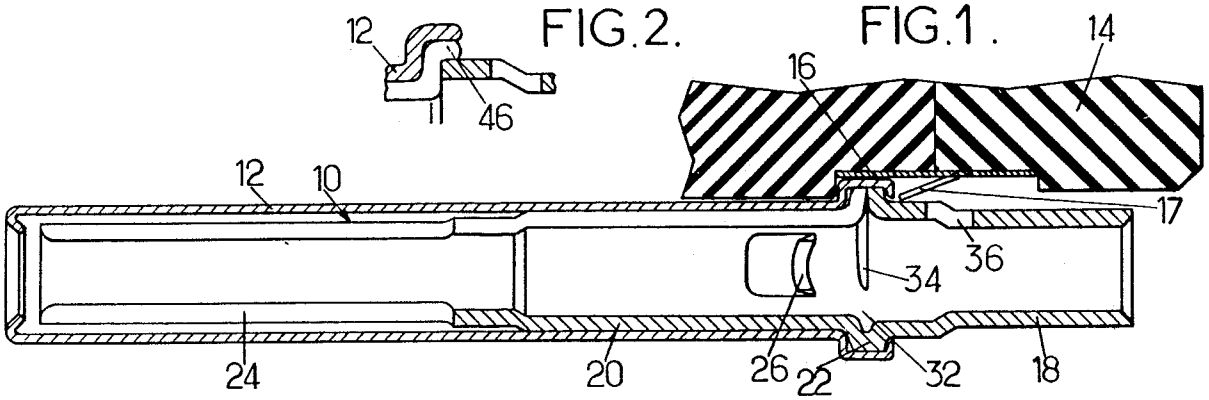
FIG. 1.
FIG. 2.
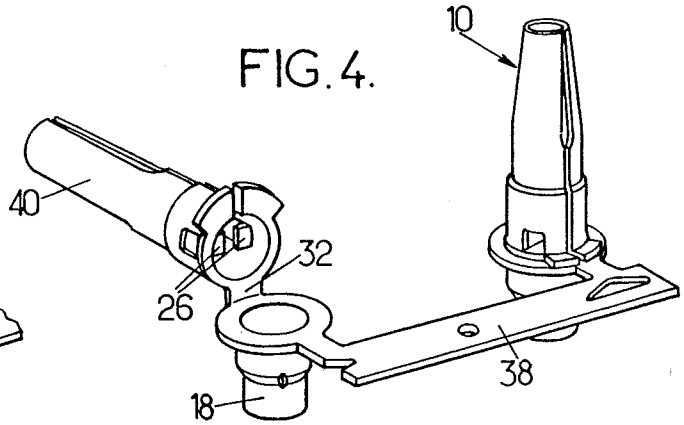
FIG. 4.
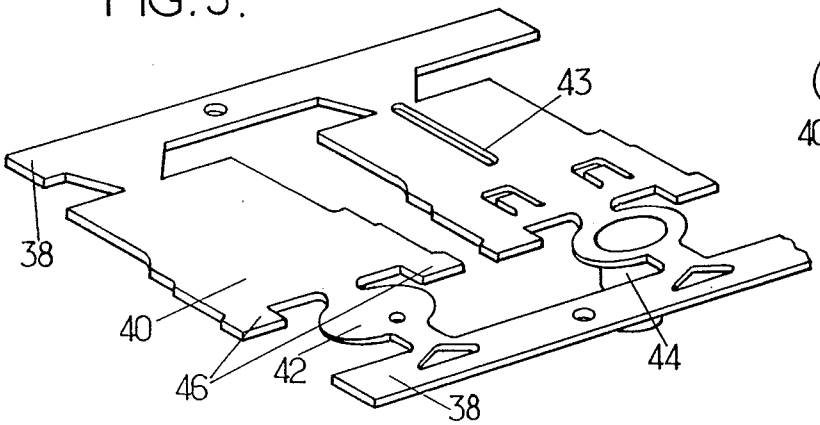
FIG. 3.

ELECTRIC CONTACT TERMINAL

BACKGROUND OF THE INVENTION

1. Field of the Invention

The invention relates to electric contact terminals used in connectors, and in particular in connectors with a large number of contacts for the transmission of low energy signals, for example in aeronautical construction.

2. Prior Art

Numerous types of contacts are already known for fulfilling this function. Due to the very large number of terminals used and the safety requirements, it is desirable for the terminals to comply with two often contradictory requirements: their unit cost must be low and they must provide reliable and durable connection between the terminal and wire. For a long time, the second result has been privileged and consequently most contact terminals have been produced by turning a bar on a machine tool, a very reliable but expensive solution.

Contact terminals may also be manufactured by cutting out and rolling a metal sheet to form a shank for fixing a conductor and a front tubular contact portion of the terminal. But most solutions proposed, such as those described in French Pat. No. 2,498,827, make it necessary to form the contact terminal in three parts and lead to a terminal whose rear shank is split, which is unfavorable to long term resistance of the electrical and mechanical connection with the conductor. Two-part contacts as that shown in European No. 0133,377 also require machined parts and do not provide a satisfactory compromise between cost and reliability.

SUMMARY OF THE INVENTION

It is an object of the invention to provide an electric contact terminal which may be manufactured by a stamping-cutting-rolling-bending sequence, a low cost technique, and which results in a contact whose shank is not split and thus provides an electrically reliable and sure fixing of an electric conductor wire.

To this end, there is provided an electrical contact terminal comprising a body with a front tubular contact fractionated into resilient contact fingers by cut-outs and a rear shank for receiving an electrical conductor and further comprising an external tube for protecting the front contact; the shank is continuous and it is separated from the body by a circumferential swelling imprisoned in a flared end part of the external tube.

Because the shank is without longitudinal split, reliable and durable fixing may be obtained by crimping or soldering.

In a typical embodiment, the contact terminal has two parts only. Its manufacture is then particularly cost saving.

In another embodiment, the tubular contact is distinct from the shank instead of being integral therewith. Then mutually different materials can be used for the tubular contact and for the shank. The material used for the shank may have characteristics adapted to a specific type of manufacture (or the method of manufacturing the shank may be adapted to the material). To sum up, the second solution makes it possible to optimize each material so as to take into account both manufacturing technique and the specifications of use of the contact (maximum current, contact resistance). The shank and the tubular contact may be fixed together by any appropriate method, such for example as soldering or crimping.

The invention also provides a method for manufacturing a terminal of the above-defined type, wherein the body is manufactured by cutting and rolling of a metal sheet to form the front tubular contact and by cutting out and stamping the rear shank.

In the first embodiment mentioned above, the whole body is made from a same metal sheet, leaving the tubular contact connected by a tongue to the part reserved for constituting the shank. Finally, the tongue is bent so as to bring the tubular contact into alignment with the shank before placing the external protection tube, which prevents unfolding and provides electric and mechanical continuity. The external tube is typically obtained by cold stamping.

When the body consists of one piece, it will be generally made from a ductile copper base alloy, from bronze or from a light alloy. The external protection tube may be of stainless steel and will often have a thickness appreciably smaller than that of the metal sheet, for example 0.1 mm instead of 0.25 mm.

The invention will be better understood from the following description of particular embodiments, given by way of a examples.

BRIEF DESCRIPTION OF THE DRAWINGS

FIG. 1 is an elevational cross-section through a plane passing through the axis of a female contact terminal in accordance with a particular embodiment of the invention;

FIG. 2, similar to a fraction of FIG. 1, shows a modified construction;

FIGS. 3 and 4 are diagrams showing successive steps for manufacturing the body of the terminal of FIG. 1; and FIG. 5, similar to a portion of FIG. 1, illustrates a modified embodiment.

DETAILED DESCRIPTION OF PREFERRED EMBODIMENTS

Referring to FIG. 1, an electric contact terminal comprises a body 10 whose front part is surrounded by an external protection tube 12. As shown, the contact terminal is intended to be mounted in an insulating block 14 and to be retained in the block by a split resilient ring 16. Ring 16 is locked in a recess in block 14 and has internal fingers 17 for maintaining an enlarged portion of the terminal applied against one of two shoulders defining the recess.

Body 10 may be regarded as comprising a rear shank 18 in the form of a continuous tube, i.e. not split, and a front tubular contact 20 which are mutually connected by an enlarged portion 22. The contact 20 has a stepped form and its front portion is split up by cut-outs 24 into resilient fingers which in operation frictionally engage a male contact (not shown). The body of the terminal shown in FIG. 1 has folded stop tabs 26 situated between the split front portion and the enlarged portion 22, for defining the fully inserted position of an electric conductor secured to the shank.

The external protection tube 12 has a constant diameter over the major part of its length; it bears on the widest portion of the contact and surrounds fingers 24 for limiting their amount of radial expansion. It extends forwardly of the fingers. The protection tube 12 has a rear radially enlarged portion defined by successive bends and forming a ring straddling the enlarged portion 22 of the body.

As shown in FIG. 1, the shank 18 and the contact 20 are integral and connected together by a tongue 32 forming a hinge, in the region of the enlarged portion 22. The tongue is defined by a semicircumferential slot 34 formed when folding the shank onto the contact, as will be seen later. Since the enlarged portion 22 is imprisoned by tube 12, the contact terminal in its final state cannot unfold and misalignment of the shank and the contact is avoided.

In shank 18 one or several holes 36 may be formed for soldering a conducting wire.

The body of the contact terminal of FIG. 1 is formed by cutting out, deep stamping and rolling a metal sheet, typically in the sequence shown schematically in FIGS. 3 and 4. This sequence is only given by way of example and the distribution of the operations between successive work stations could be modified.

In a first work station, a metal sheet is cut out and stamped in a press which leaves two marginal strips 38 connecting together blanks each having a portion 40 intended to form a contact and an approximately circular portion 42 intended to form a shank (FIG. 3). A tongue 32 is left between portions 40 and 42 so as to form a hinge. In the following working station (or stations) a slot 43 is stamped so as to provide one of the cut outs 24 (the other cut out being formed when bringing together the edges of portion 40). The retention tabs 26 are stamped. A first stamping pass using a puncheon forms a blank 44 of the shank.

In the following stations (FIG. 4), one of the marginal strips 38 is stamped; portion 40 is rolled so as to form contact 20 and tabs 26 are deformed inwardly. Blank 44 is drawn so as to give it the final shape of shank 18. It should be noted that portion 40 has two lateral lugs 46 which will finally be placed side by side and serve for retention by tube 12. Finally, the tubular contact is bent around tongue 32 until lugs 46 bear on the end flange of the shank. It is desirable to give an appreciable amount of peripheral development to the lugs so as to improve bearing.

Body 10 is then detached from the remaining marginal strip 38, tube 12 is positioned and one of its ends is crimped on the enlarged portion 22 formed by the end flange of the shank, the hinge forming tongue 32 and lugs 46.

In the modified embodiment shown in FIG. 2, the end of tube 12 is not completely crimped. It is bent twice. The lugs 46 are also bent over the end of the shank, which is devoid of flange, instead of forming a flat bearing surface.

The material forming the body will typically be one of those generally used in the connector field, particularly copper alloys or light alloys sufficiently ductile for drawing out shank 18. Once finished, the body is subjected to surface or in-depth treatments; for example it is coated with a layer of ductile and nonporous nickel a few microns thick, then with a gold layer less than one micron thick. The protection tube, generally two or three times thinner than the body, may be of ferrous material, typically of stainless steel. Stainless steels are available having sufficient ductility to make it possible to produce tube 12 by cold hammering, stamping, direct or reverse extrusion.

In a modified embodiment, the front tubular contact is formed by stamping and rolling a sheet of a metal material which has high mechanical characteristics. The shank is formed separately by stamping a metal sheet material lending itself to stamping, such as copper alloys with a high degree of cold deformation. The shank and the tubular contact are positioned then fixed to each other. The assembly is held in position by the external protection tube (FIG. 5). So as to make possible crimping which provides a good bond, the lugs 46 are for example replaced by a collar extending all around the contact.

The invention is not limited in use to female contact terminals described by way of examples. It has a much widest scope and may be applied whatever the construction of the front part, more particularly if the latter is a male contact.

I claim:

1. Electrical contact terminal for connectors, comprising a body having a rolled front tubular contact of sheet metal longitudinally split throughout its length and fractionated into circumferentially distributed contact fingers by longitudinal slots extending over only part of said front tubular contact from a front opening thereof and having a rear shank shaped for receiving an electrical conductor; and an external tube for protecting said front contact; said shank being continuous and uninterrupted and having a connecting zone with the tubular contact including a circumferential swelling of said body imprisoned in a flared end part of the external tube.

2. Terminal according to claim 1, wherein said tubular contact is integral with the shank and made of rolled metal sheet.

3. Terminal according to claim 1, wherein said circumferential swelling consists of a folded tongue connecting the shank to the tubular contact and tabs projecting from the tubular contact and bearing on the shank.

4. Terminal according to claim 1, wherein the tubular contact is distinct from the shank, is of a different material and is clamped to the shank by said flared end part of the external tube.

5. Terminal according to claim 1, wherein said flared end part of the external tube is defined by folds which at least partially clamp said circumferential swelling of the body.

6. Electrical contact terminal for connectors, comprising:

a body having a rolled front tubular contact split by a slit extending throughout its length and fractionated into circumferentially distributed contact fingers by longitudinal slots extending over only part of said front tubular contact from a front opening thereof and having a stamped rear shank integral with said tubular contact and shaped for receiving an electrical conductor; and an external tube for protecting said front contact;

said shank being continuous, uninterrupted and connected with the tubular contact in alignment therewith by a folded tongue diametrically opposed to said slit and by a flared end part of the external tube which clamps said folded tongue.

7. Terminal according to claim 6, further comprising said circumferential swelling further comprises a pair of folded tabs projecting from a rear portion of the tubular contact and diametrically opposed to said tongue, clamped by said flared end part against a front swelling of said shank.

8. Electrical contact terminal for connectors, comprising a body and an external protection tube coaxial thereto, wherein:

said body consists of:

a rolled front tubular contact having a longitudinal slit extending throughout the length thereof and fractionated into circumferentially distributed contact fingers by longitudinal slots extending over only part of said front tubular contact from a front opening thereof, and a rear shank distinct from said tubular contact, said shank being continuous, uninterrupted, shaped for receiving an electrical conductor and having a connecting zone with the tubular contact; and said external tube surrounds said tubular contact and has a flared end part clamping mutually abutting flanges of said shank and tubular contact.

9. Terminal according to claim 8, wherein said body is of copper base alloy and the tube is of stainless steel, said tube having a thickness of from one third to one half of the thickness of the body.

* * * * *